US010824084B2

(12) United States Patent
Nedelin et al.

(10) Patent No.: US 10,824,084 B2
(45) Date of Patent: Nov. 3, 2020

(54) PRINT AGENT TRANSFER ASSEMBLIES

(71) Applicant: HP INDIGO B.V., Amstelveen (NL)

(72) Inventors: Peter Nedelin, Ness Ziona (IL); Shai Lior, Ness Ziona (IL); Mark Sandler, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/603,795

(22) PCT Filed: Apr. 10, 2017

(86) PCT No.: PCT/EP2017/058562
§ 371 (c)(1),
(2) Date: Oct. 8, 2019

(87) PCT Pub. No.: WO2018/188726
PCT Pub. Date: Oct. 18, 2018

(65) Prior Publication Data

US 2020/0110347 A1 Apr. 9, 2020

(51) Int. Cl.

| | |
|---|---|
| ***G03G 15/10*** | (2006.01) |
| ***G03G 13/20*** | (2006.01) |
| ***G03G 13/10*** | (2006.01) |
| ***G03G 15/11*** | (2006.01) |

(52) U.S. Cl.
CPC ..... *G03G 13/20* (2013.01); *G03G 13/10* (2013.01); *G03G 15/11* (2013.01); *G03G 2215/0409* (2013.01); *G03G 2215/0658* (2013.01)

(58) Field of Classification Search
CPC ..... G03G 13/10; G03G 13/20; G03G 15/10; G03G 15/11; G03G 15/161; G03G 2215/0409; G03G 2215/0658
See application file for complete search history.

(56) References Cited

U.S. PATENT DOCUMENTS

| | | | | |
|---|---|---|---|---|
| 5,737,678 | A | 4/1998 | Volkers | |
| 8,100,510 | B2 | 1/2012 | Carlson | |
| 8,212,847 | B2 | 7/2012 | Kella | |
| 9,025,990 | B2 | 5/2015 | Schlumm | |
| 2005/0025534 | A1* | 2/2005 | Fujita | G03G 15/1665 399/307 |
| 2007/0274734 | A1* | 11/2007 | Kikuchi | G03G 15/205 399/67 |

(Continued)

FOREIGN PATENT DOCUMENTS

| | | |
|---|---|---|
| JP | H11-065294 | 3/1999 |
| JP | 2001-1235927 | 8/2001 |
| JP | 2012-042954 | 3/2012 |

(Continued)

OTHER PUBLICATIONS

HP Indigo Digital Offset Color Technology, 2011, < http://www8.hp.com/h20195/V2/getpdf.aspx/4AA1-5248ENW.pdf?ver=1.0 >.

*Primary Examiner* — Sophia S Chen
(74) *Attorney, Agent, or Firm* — Dierker & Kavanaugh PC

(57) ABSTRACT

A print agent transfer assembly including a print agent transfer member to receive a first layer and a second layer of print agent, and an energy source to provide energy at a first predetermined intensity level to the first layer and to provide energy at a second, different predetermined intensity level to the second layer.

13 Claims, 5 Drawing Sheets

300

(56) References Cited

U.S. PATENT DOCUMENTS

| | | | | |
|---|---|---|---|---|
| 2016/0132000 | A1* | 5/2016 | Nelson | G03G 15/2007 399/336 |
| 2017/0293250 | A1* | 10/2017 | Diamant | G03G 21/0058 |

FOREIGN PATENT DOCUMENTS

| | | |
|---|---|---|
| JP | 2014-215388 | 11/2014 |
| WO | WO-2011096085 | 8/2011 |
| WO | WO-2014077805 | 5/2014 |
| WO | WO-2016000748 | 1/2016 |
| WO | WO-2016041598 | 3/2016 |

* cited by examiner

300

400

500

PRINT AGENT TRANSFER ASSEMBLIES

BACKGROUND

Printing systems such as liquid electro photographic (LEP) printers may form images on a photoconductive member using liquid toner and the like. The images may be transferred to an intermediate member on which they are dried. The images may then be transferred to media.

BRIEF DESCRIPTION OF DRAWINGS

For a more complete understanding, reference is now made to the following description taken in conjunction with the accompanying drawings in which.

DETAILED DESCRIPTION

Printing systems such as liquid electro photographic (LEP) printers include a transfer member that receives images from an image forming member. The image may be formed on the image forming member using liquid toner (hereinafter print agent). The image, also referred to as a layer of print agent, is transferred to the transfer member on which it is at least partially dried using a heat source. The layer of print agent may then be transferred to a substrate. An image formed on the substrate may comprise multiple layers of print agent, which may be liquid when applied. In some examples, multiple layers may be transferred onto the transfer member before being simultaneously applied to the substrate. In other examples, layers may be transferred one-by-one onto the transfer member then to the substrate, such that one layer is present on the transfer member at a time.

Figure 1:
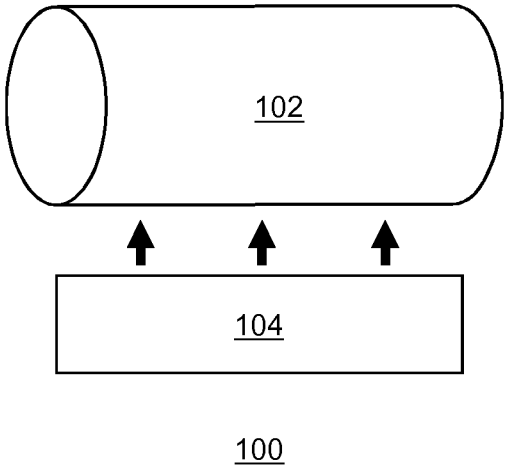
FIG. 1 shows an example of a print agent transfer assembly.

FIG. 1 shows an example of a print agent transfer assembly 100 comprising a print agent transfer member 102 to receive a first layer and a second layer of print agent. In some examples, the first and second layers of print agent are received from an image forming member. The print agent transfer assembly 100 also comprises an energy source 104 to provide energy at first predetermined intensity level to the first layer and to provide energy at a second, different, predetermined intensity level to the second layer. This provides a drying facility to the first and second layers. In some examples, the energy source 104 is to provide energy after receiving each layer, such that for example the energy source 104 is to provide energy at the first predetermined intensity level after receiving the first layer and at the second predetermined intensity level after receiving the second layer. In some examples, there may be a controller or the like to control the energy output by the energy source.

In some examples, the second layer is received over the first layer on the transfer member 102. In some examples, the first layer is transferred from the transfer member 102, for example to a substrate, before the transfer member 102 is to receive the second layer.

The energy source 104 may for example provide energy to soften toner or resin particles within the print agent, to cause such particles to coalesce into a layer, to evaporate a portion of a liquid content of the print agent and/or to make the remaining print agent layer 'sticky' so it adheres to a substrate. By providing energy at different predetermined intensity levels to different layers, the print agent transfer assembly 100 may provide a level of energy that is appropriate for each layer. In some examples, the intensity level provided to a layer may be based, at least in part, on a print agent type used for that layer. For example, print agents with darker pigments may absorb energy at a higher rate than print agents with lighter pigments, and consequently the intensity level to be provided to a layer of print agent may be lower for print agents with darker pigments. The method of FIG. 1 may therefore avoid a compromise between over-heating of a darker layer and under-heating of a lighter colored layer. Over- and/or under-heating may in turn affect print agent adhesion to a substrate, print quality and/or the choice of substrates available and the like.

In some examples, the intensity level provided to a layer of print agent may be determined, at least in part, based on a number of further layers to be received on the transfer member over the layer. For example, where a first layer is received at the transfer member and a second layer is received at the transfer member on top of the first layer, the energy level provided to the first layer may be lower than the energy level provided to the second layer. The first layer may absorb some energy, and therefore continue to be dried, while energy is being applied to the second layer at the second intensity level. By considering the absorption of energy when subsequent layers are applied, the total energy consumption maybe reduced and/or 'over-drying' of an early layer may be prevented or reduced. In some examples, the first intensity level provided to the first layer by the energy source 104 may be zero. Therefore, for example, the first layer does not receive energy from the energy source 104 before the second layer is received by the transfer member on top of the first layer. The first layer may then absorb some energy while energy is being applied to the second layer at the second intensity level. In some examples, the intensity level provided to the second layer may also be determined based on a number of further layers to be received by the transfer member over the second layer. This may avoid a compromise between under-heating a later layer (for example, a final layer) and over-heating an earlier layer (for example, a first layer).

In some examples, the intensity level provided to a layer of print agent may be determined, at least in part, based on a thickness of the layer of print agent. For example, a higher intensity level may be selected for a thicker layer than for a thinner layer. This may therefore avoid a compromise being made between over-heating of a thinner layer, and under-heating of a thicker layer.

Figure 2:
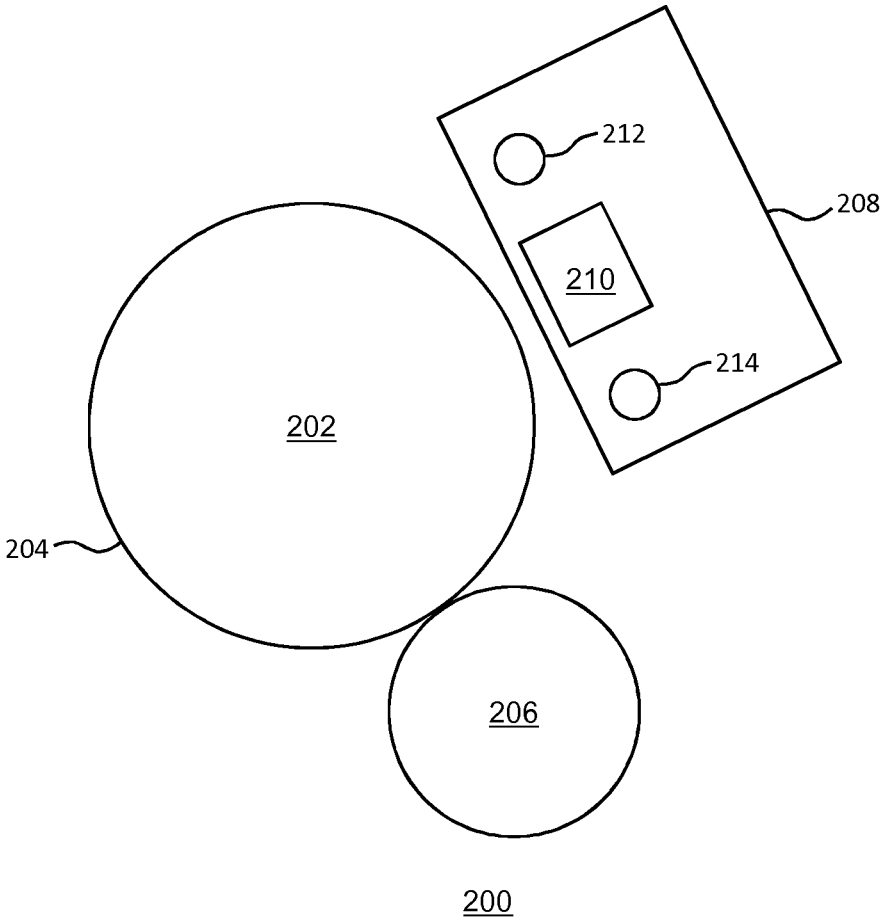
FIG. 2 shows an example of a print agent transfer assembly.

FIG. 2 shows an example of a print agent transfer assembly 200. The assembly 200 includes a print agent transfer member 202, which may be referred to in some examples as an intermediate transfer member (ITM). First and second layers of print agent are to be received by the print agent transfer member 202 by being deposited on an outer surface 204 of the transfer member 202 from an apparatus (not shown) that forms each layer of print agent.

The print agent transfer assembly 200 includes a media drum 206 to receive media whilst a layer of print agent is transferred to the media from the transfer member 202. For example, the media may contact a layer of print agent on the surface 204 and hence the layer is transferred to the media.

In some examples, a second layer of print agent is received on top of a first layer on the surface 204 before the first and second layers are transferred simultaneously to media on the media drum 206. In some examples, the first layer is transferred from the surface 204 to the media before the second layer is received on the surface 204.

In some examples, the second layer of print agent may comprise the same print agent (such as, for example, the same color) as the first layer. In some examples, further layers of print agent may be received on the print agent transfer assembly. In some examples, up to seven layers may be so received. For example, third, fourth, fifth, sixth and seventh layers may be received. In some examples, more than seven layers may be received.

The print agent transfer assembly 200 also includes an energy source 208 to provide energy to a layer of print agent on the surface 204. In some examples, the energy source 208 may comprise an energy source that may change its output level quickly compared to the time between the transfer of different layers to the transfer member 202. For example, the time between the start of transfer of a stack of layers may in some examples be on the order of around a few hundred milliseconds (e.g. 100-300 ms, and in some examples, around 215 ms), and the time between the end of transfer of one layer to the transfer member 202 and the start of transfer of the next layer to the transfer member may be on the order of tens of milliseconds (e.g. 10-50 ms, in some examples, around 35 ms). In some examples, the energy source 208 may be selected on the basis that is may increase or decrease its output in the time between the end of transfer of one layer to the transfer member 202 and the start of transfer of the next layer to the transfer member. For example, the energy source 208 may be able to increase or decrease its energy output in less than 35 ms.

The energy source 208 in this example includes an array of vertical cavity surface emitting lasers (VCSELs) 210 extending across the width of a layer of print agent on the surface 204 and controlled to provide energy at a predetermined level of intensity to the layer on the surface 204. In some examples, the array of VCSELs 210 can switch from one level of energy output intensity to another in around, or less than one millisecond. As a result, each layer of print agent on the surface 204 may receive a respective predetermined level of energy intensity from the array of VCSELs 210. In some examples, the energy source may comprise an alternative technology, for example an array of light emitting diodes (LEDs) to provide energy to a layer of print agent. LEDs may also be associated with fast output control, for example switching from one level of energy output intensity to another in around, or less, than one millisecond.

In some examples, other sources of heating may also be present, such as for example internal heating of the transfer member 202. In some examples the heat supplied by the transfer member 202 may be taken into account when determining the energy to be provided to a layer.

The energy source 208 also includes an air source 212 and an exhaust 214 for directing air flow over a layer of print agent on the surface 204. The air source 212 may be controlled to provide some additional control over the heating of a layer, and/or an air flow rate may be taken into account when determining the energy to be provided to a layer.

By providing energy at different predetermined intensity levels to different layers, the print agent transfer assembly 200 may provide a level of energy that is appropriate for each layer. As noted above, the intensity level provided to a layer may be based on a print agent type used for that layer, a number of further layers to be received on the surface 204 over the layer and/or a thickness of the layer of print agent.

Figure 3:
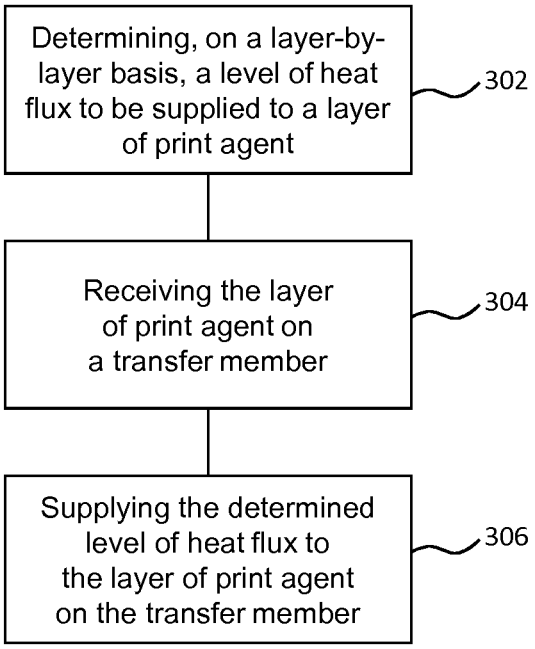
FIG. 3 shows a flowchart of an example of a method of transferring a layer of print agent.

FIG. 3 is an example of a method 300, which may be a method of transferring a layer of print agent. The method 300 comprises, in block 302, determining, on a layer-by-layer basis, a level of heat flux to be supplied to a layer of print agent. In some examples, the level of heat flux for a layer of print agent may be determined based on at least one of a type of the print agent in the layer of print agent, a number of further layers to be received on a transfer member over the layer of print agent, and a thickness of the layer of print agent.

The method also comprises, in block 304, receiving the layer of print agent on a transfer member. The method comprises, in block 306, supplying the determined level of heat flux to the layer of print agent on the transfer member.

Figure 4:
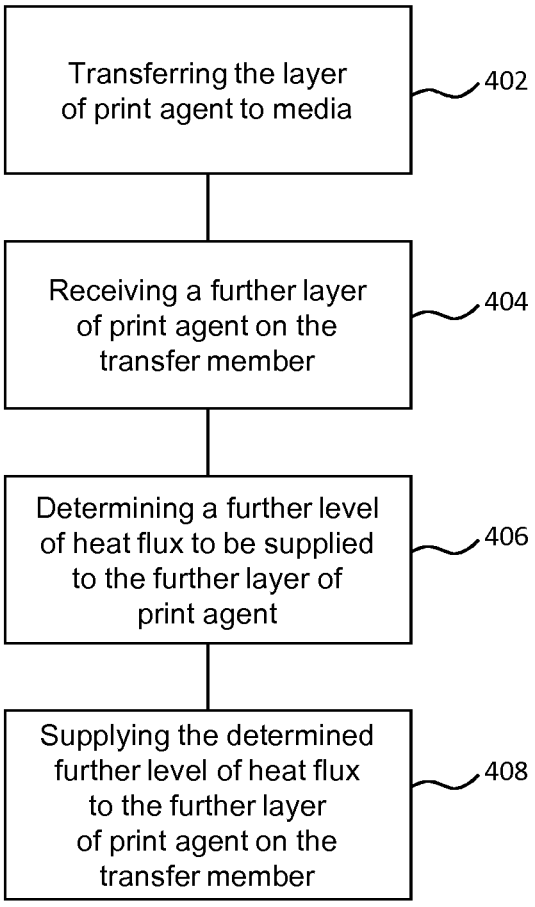
FIG. 4 shows a flowchart of an example of a method of transferring a layer of print agent.

FIG. 4 shows an example of a method 400, which may be a method of transferring layers of print agent, and which may follow the method of FIG. 3. The method 400 comprises, in block 402, transferring the layer of print agent to media, and in block 404, receiving a further layer of print agent on the transfer member. Therefore, for example, each layer of print agent may individually be received at the transfer member, treated with heat flux, and transferred to media. The method 400 may further include, in block 406, determining a further level of heat flux to be supplied to the further layer of print agent, and in block 408, supplying the determined further level of heat flux to the further layer of print agent on the transfer member.

Figure 5:
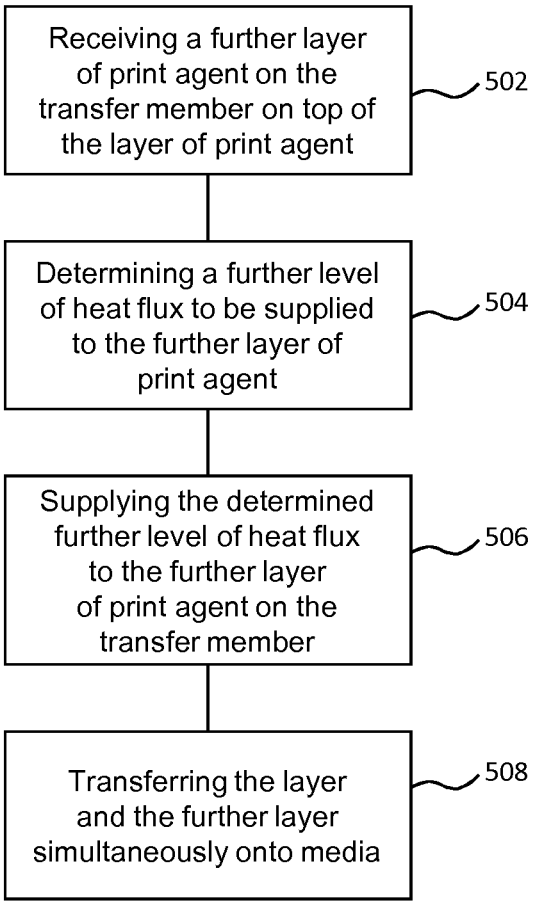
FIG. 5 shows a flowchart of an example of a method of transferring a layer of print agent.

FIG. 5 shows an example of a method 500, which may be a method of transferring layers of print agent, and which may follow the method of FIG. 3. The method 500 comprises, in block 502, receiving a further layer of print agent on the transfer member on top of a layer of print agent, and in block 504, determining a further level of heat flux to be supplied to the further layer of print agent. The method 500 also includes, in block 506, supplying the determined further level of heat flux to the further layer of print agent on the transfer member, and in block 508, transferring the layer and the further layer simultaneously onto media. Thus, for example, multiple layers are built up on the transfer member before being simultaneously transferred to the media.

Figure 6:
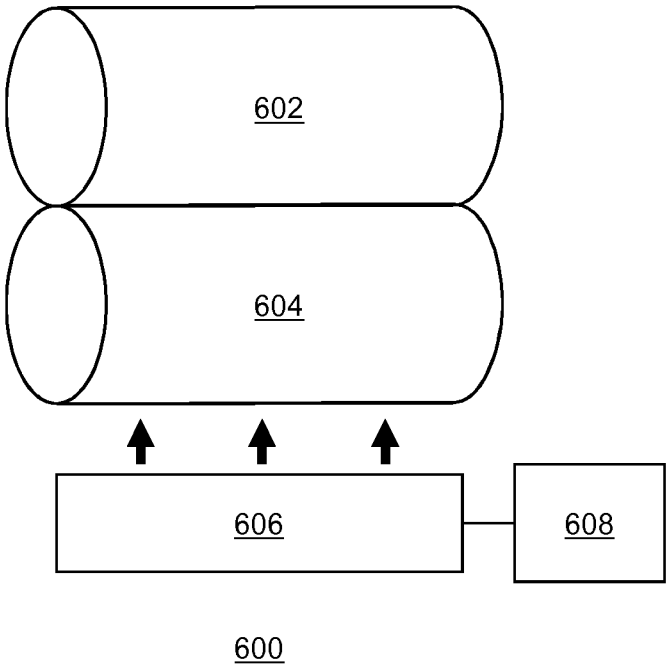
FIG. 6 shows an example of a print apparatus.

FIG. 6 shows an example of a print apparatus 600. The print apparatus 600 comprises a first roller 602 to form a layer of print agent. A second roller 604 is to receive the layer of print agent from the first roller 602. A heater 606 is to heat the layer of print agent on the second roller. A controller 608 controls the heater to a predetermined output level based on at least one layer characteristic. In some examples, a layer characteristic may be a position of the layer in a stack of layers that is deposited on the transfer roller 604 before being transferred to a web. In some examples, a layer characteristic may be a heat absorption property of the layer, such as for example one of a layer thickness, layer brightness and layer color.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams, can be realized at least in part by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent transfer assembly comprising:

a print agent transfer member to receive a first layer and second layer of print agent, the first layer and second layer defining a multilayer image; and an energy source to provide energy at a first predetermined intensity level to the first layer and to provide energy at a second, different, predetermined intensity level to the second layer.

2. The print agent transfer assembly of claim 1, wherein the first predetermined intensity level is predetermined based on at least one of:

a type of print agent in the first layer of print agent;

a number of further layers to be received at the print agent transfer member over the first layer of print agent; and a thickness of the first layer of print agent.

3. The print agent transfer assembly of claim 1, wherein the energy source comprises at least one of a plurality of light emitting diodes (LEDs) and a plurality of vertical cavity surface emitting lasers (VCSELs).

4. The print agent transfer assembly of claim 1, wherein the print agent transfer member is to receive the first and second layers of print agent before the first and second layers of print agent are transferred simultaneously to a substrate.

5. The print agent transfer assembly of claim 1, wherein the first predetermined intensity level is lower than the second predetermined intensity level.

6. The print agent transfer assembly of claim 5, wherein the first predetermined intensity level is zero.

7. A print agent transfer assembly comprising:

a print agent transfer member to receive a first layer and second layer of print agent; and an energy source to provide energy at a first predetermined intensity level to the first layer and to provide energy at a second, different, predetermined intensity level to the second layer;

wherein the print agent transfer member is to transfer the first layer of print agent to a substrate before receiving the second layer of print agent.

8. A method comprising:

determining, on a layer-by-layer basis, a level of heat flux to be supplied to a layer of print agent of a multi-layer image;

receiving the layer of print agent on a transfer member; and supplying the determined level of heat flux to the layer of print agent on the transfer member.

9. The method of claim 8, wherein determining the level of heat flux comprises determining the level based on one of:

a type of print agent in the layer of print agent;

a number of further layers of print agent to be received at the transfer member over the layer of print agent; and a thickness of the layer of print agent.

10. The method of claim 8, comprising:

receiving a further layer of print agent on the transfer member on top of the layer of print agent;

determining a further level of heat flux to be supplied to the further layer of print agent;

supplying the determined further level of heat flux to the further layer of print agent on the transfer member; and transferring the layer and the further layer simultaneously onto media.

11. The method of claim 10, wherein the level of heat flux is lower than the further level of heat flux.

12. The method of claim 10, wherein the level of heat flux is zero, and the further level of heat flux is non-zero.

13. A method comprising:

determining, on a layer-by-layer basis, a level of heat flux to be supplied to a layer of print agent;

receiving the layer of print agent on a transfer member;

supplying the determined level of heat flux to the layer of print agent on the transfer member;

transferring the layer of print agent to media;

receiving a further layer of print agent on the transfer member;

determining a further level of heat flux to be supplied to the further layer of print agent; and supplying the determined further level of heat flux to the further layer of print agent on the transfer member.

* * * * *